US005373975A

United States Patent [19]

Husted

[11] Patent Number: 5,373,975

[45] Date of Patent: Dec. 20, 1994

[54] WATER GUN

[76] Inventor: Royce H. Husted, 711 Lakeside Dr., Wheaton, Ill. 60187

[21] Appl. No.: 923,101

[22] Filed: Jul. 30, 1992

[51] Int. Cl.[5] ..... B65D 83/00

[52] U.S. Cl. ..... 222/394; 222/400.7; 222/402.16; 222/402.1; 222/402.25

[58] Field of Search ..... 222/394, 395, 398, 399, 222/400.7, 402.16, 402.1, 402.14, 402.15, 402.25

[56] References Cited

U.S. PATENT DOCUMENTS

| | | | |
|---|---|---|---|
| 519,604 | 5/1894 | Hatton | 222/399 |
| 659,895 | 10/1900 | Peters | 222/399 |
| 2,830,745 | 4/1958 | Aicart | 222/394 |
| 2,937,698 | 5/1960 | Greenlee | 222/399 |
| 3,262,609 | 7/1966 | Poitras | 222/399 |
| 4,782,982 | 11/1988 | Ellison | 222/1 |
| 4,930,664 | 6/1990 | Ellison | 222/1 |
| 4,982,879 | 1/1991 | Corrado et al. | 222/399 X |
| 4,995,534 | 2/1991 | Norman | 222/394 X |

*Primary Examiner*—David H. Bollinger
*Attorney, Agent, or Firm*—Nicholas A. Camasto

[57] ABSTRACT

A toy water gun includes a molded plastic handle having a hose coupling thread at one end and a bottle thread coupling at the other end. A trigger and a nozzle are formed in the handle with the trigger displacing a ball from its seat to form a water jet. A check valve includes a ball that is held against its seat in the hose thread coupling end of the handle by pressure in a water reservoir. A siphon tube is used in one version for reaching to the bottom of a plastic bottle reservoir that is screwed into the bottle thread coupling of the handle. An adapter may be screwed into the bottle thread coupling of the handle and coupled to one or more plastic bottle reservoirs that are carried in a backpack. The water gun is charged with pressurized water from a household water spigot by screwing it to the spigot and forcing water under pressure into the reservoir. A two piece handle version is also disclosed.

16 Claims, 3 Drawing Sheets

WATER GUN

BACKGROUND OF THE INVENTION AND PRIOR ART

This invention relates in general to toy water guns and in particular to a pump-less toy water gun that utilizes a readily available reservoir that is easily fillable from a household source of pressurized water, such as a garden hose or a water spigot.

Water pistols (or squirt guns) have been popular toys for many years. Their drawbacks are well known and include the need to continually pump limited capacity and range, difficulty in refilling, etc. A common type of water gun has a trigger-operated pump mechanism for pressurizing and ejecting a relatively small, short duration jet of water. More recently, water guns that incorporate a large reservoir of water, that is pressurized by pumping have become popular. This latter type of water gun is capable of propelling a jet of water farther and for a duration that is controlled by the depression of the trigger mechanism (so long as there is pressure in the reservoir). The vast majority of such water guns include a manually-operated pump for developing a pressure head of air in the water reservoir. Operation of a trigger controls the water formation and duration of the water jet.

The so-called "single shot" water guns (with a non-pressurized water reservoir and a trigger pump) are limited in range and the length and duration of the water jet is a function of a user's skill in manipulating the trigger. These water guns are of relatively low cost construction and use the interior of a hollow plastic gun body as the (non-pressurized) water reservoir. Pressurized reservoir types of water guns require a great deal of manual pumping to produce a suitable pressure head in the reservoir. The reservoir (or reservoirs in the case of multiple reservoir guns) are often removable for refilling. Even so, refilling the removable reservoirs requires some dexterity on the user's part and is a slow and messy task. Also, the cost of such water guns is very high.

The water gun of the invention overcomes the limitations of the prior art devices and is characterized by no pumping, high capacity, ruggedness, long and accurate shooting, low cost and ease of filling and operation. The body of the inventive water gun comprises a handle that houses a trigger and a nozzle, and in the preferred embodiment, includes a hose thread coupling end for connection to a source of household pressurized water (such as a spigot or a garden hose) and a reservoir coupling end. The reservoir coupling end has a bottle thread that is adapted to engage the threaded end of an empty one- or a two-liter PET type plastic bottle, such as are commonly used for carbonated soft drinks and the like. In one version of the invention, the plastic bottle is affixed to the handle which also includes a weighted end flexible siphon tube that extends into the reservoir for permitting operation of the squirt gun with the reservoir higher or lower than the handle. In another version, a backpack is provided for holding one or more of the reservoir bottles which are coupled by an adapter to the handle via a manifold and a flexible tube. Refilling is accomplished through the hose coupling on the handle and is automatically stopped when the trapped air in the reservoir is pressurized to the pressure of the water source. The reservoir bottles need not be removed for refilling either in the attached mode or in the backpack mode. In a special feature of the invention, a special sealing end on the reservoir bottle thread coupling is provided to make a seal with a collar that is adjacent the threaded end of the reservoir bottle. This collar is only present in PET type plastic bottles and the arrangement precludes use of other containers with bottle cap threads, i.e. glass bottles. Still another version of the invention uses a separable two piece handle with a male hose thread on the upper portion fitting with a female hose thread coupling on the lower portion.

OBJECTS OF THE INVENTION

A principal object of the invention is to provide an improved water gun.

Another object of the invention is to provide a water gun that is pressurized from a household source of pressurized water.

A further object of the invention is to provide a water gun that does not require manual pumping.

A still further object of the invention is to provide a fluid propulsion toy that is rugged, low cost, simple to manufacture and easy to use.

BRIEF DESCRIPTION OF THE DRAWINGS

These and other objects and advantages of the invention will be apparent upon reading the following description in conjunction with the drawings, in which.

DESCRIPTION OF THE PREFERRED EMBODIMENT

Figure 3:
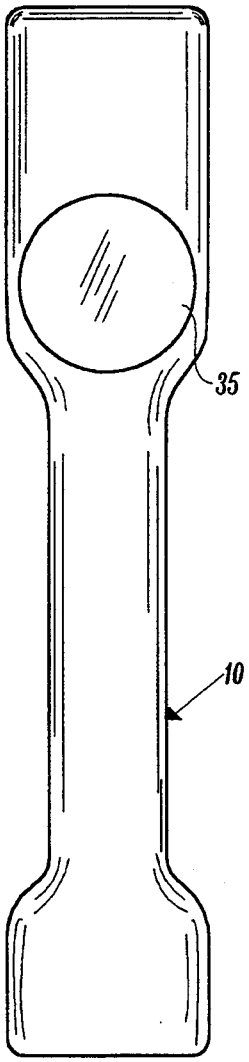
FIG. 3 is a left elevation view of the handle of the water gun of FIG. 1.
Figure 1:
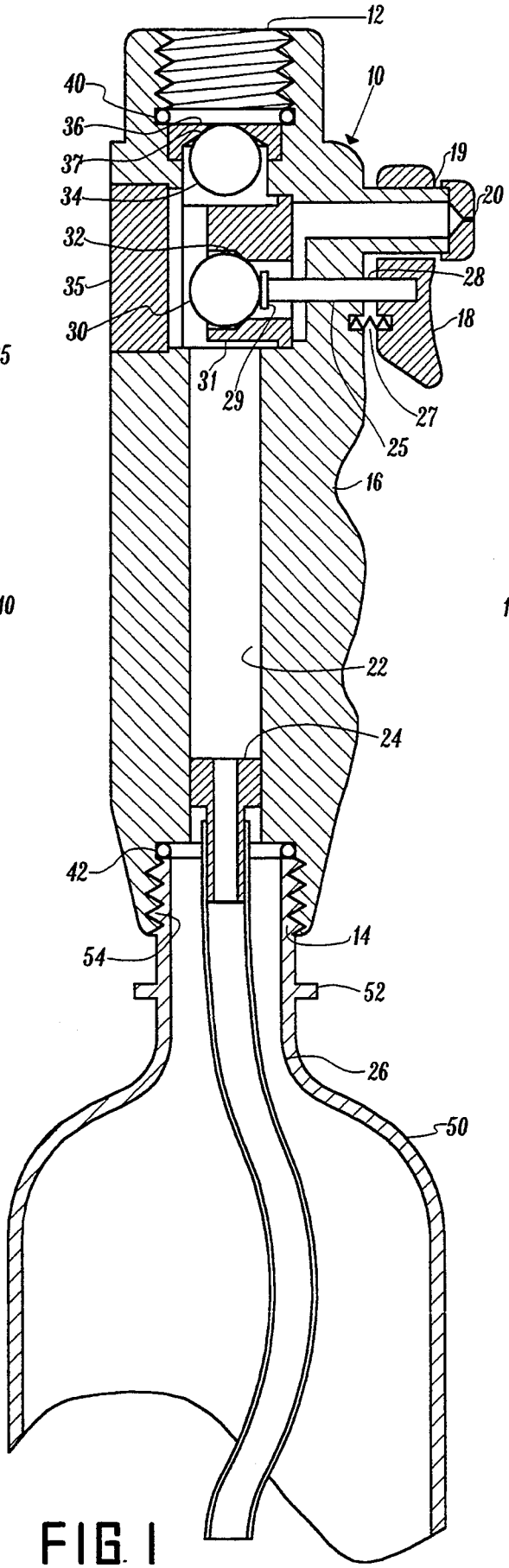
FIG. 1 is a partial cutaway view of the water gun of the invention.
Figure 2:
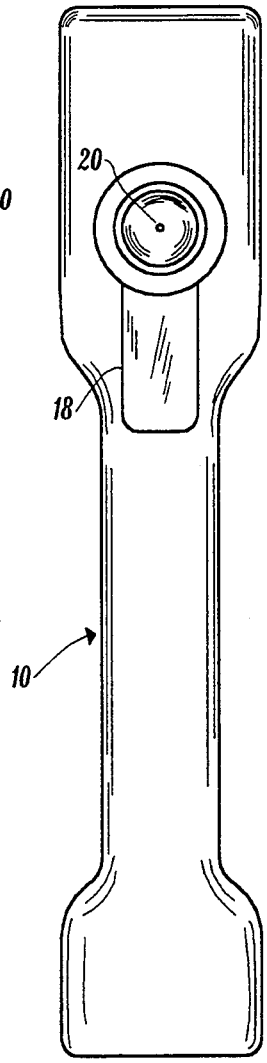
FIG. 2 is a right elevation view of the handle of the water gun of FIG. 1.

Referring to FIGS. 1, 2 and 3, a handle 10 is molded of a suitable plastic material and includes an internally formed hose thread coupling 12 at one end and an internally formed bottle thread coupling 14 at the opposite end. A contoured grip 16 comprises the central portion of handle 10. A trigger 18 is adapted to ride on a cylindrical bushing 19 which extends from handle 10. A nozzle 20 covers the end of bushing 19. The arrangement enables the handle 10 to be held in a user's hand for operating a trigger 18 with an index finger. Nozzle 20 communicates with a hollow channel 22 that extends throughout the handle 10. A pressed-in insert 24 seals the lower portion of channel 22. A very flexible siphon tube 26 is fitted to a flange on insert 24 and communicates with channel 22. The trigger 18 is affixed to a cylindrical plunger 28 that extends through a bore 25 in handle 10 and terminates in a shoulder 29. Shoulder 29 bears against a trigger ball 30 that is associated with a trigger seat 32 that is formed in an insert 31 which is affixed to the interior of handle 10 as illustrated. The communication of nozzle 20 with channel 22 is controlled by trigger ball 30 and trigger seat 32. A return spring 27 is captivated in opposed blind holes in handle 10 and trigger 18 for urging the trigger 18 to an outward (inactivated) position against nozzle 20. Nozzle 20 comprises a cap that is fitted over the end of bushing 19 and serves to captivate trigger 18 on handle 10. A check valve is formed by a ball 34 which engages a seat 36 formed in an insert 37 at the base of hose thread coupling 12 in the end of handle 10. An O-ring 40 is positioned in the base of hose thread coupling 12 for sealing handle 10 when filling or refilling the reservoir from a source of pressurized water. Another O-ring 42 is positioned in bottle thread coupling 14 at the other end of handle 10 for making a seal with a reservoir bottle 50. Reservoir bottle 50 includes a collar 52 that is spaced from its threaded open end. A circular sealing plug 35 is positioned in a mating hole in the rear of handle 10 for sealing channel 22 after the internal parts (balls 30, 34,, inserts 31, 37 and plunger 28) are installed. The junctions of the inserts 31, 37 and plug 35 with handle 10 are preferably sealed by ultrasonic welding. After trigger 18 is installed, nozzle 20 is secured to the end of bushing 19. As mentioned, insert 24 is pressed into channel 22.

Figure 4:
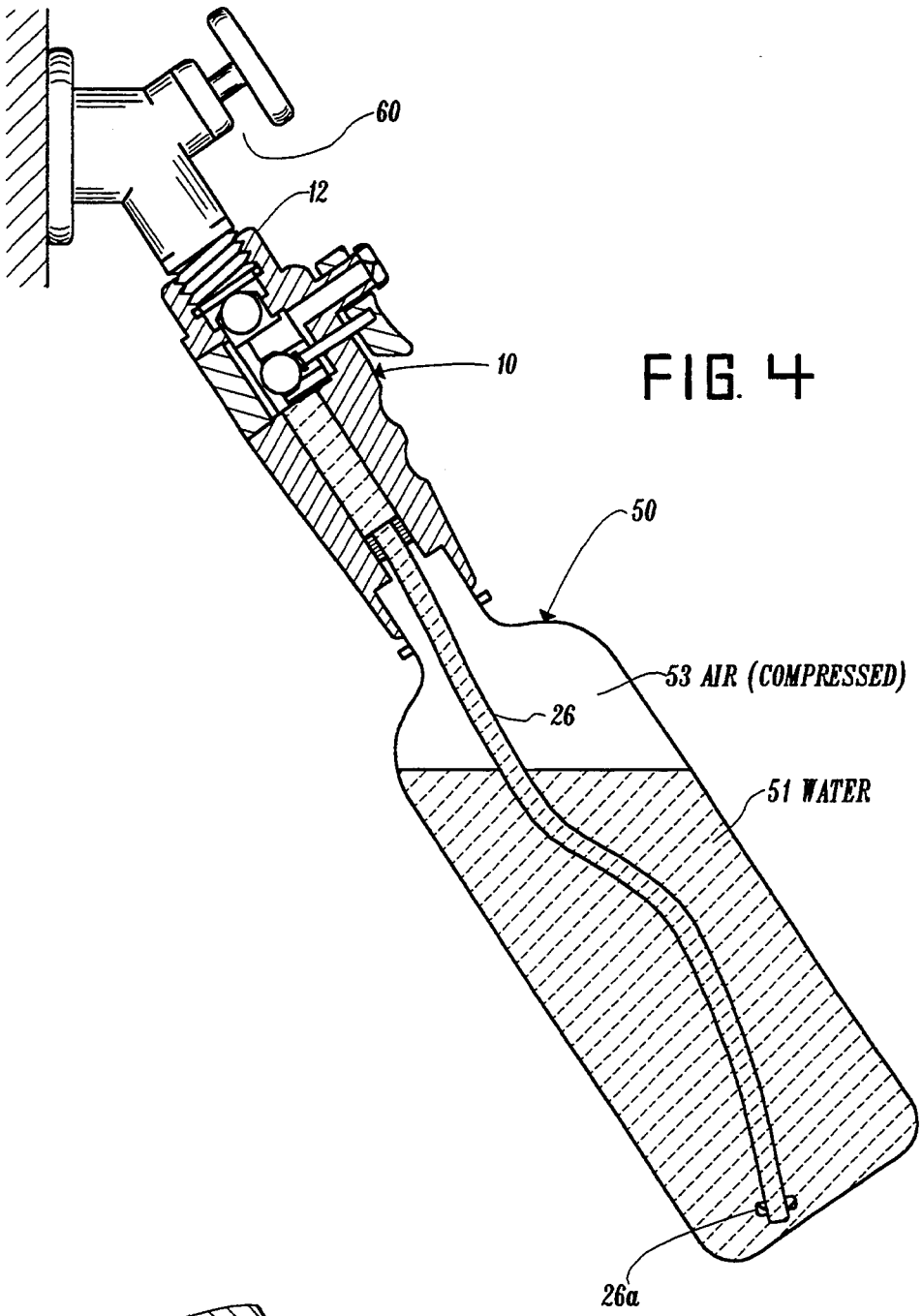
FIG. 4 is an illustration showing filling of the water gun of the invention from a household water spigot.

In FIG. 4, a household water spigot 60 is shown with hose thread coupling 12 on the end of handle 10 screwed into position for filling of reservoir bottle 50 with water. Reservoir 50 is sealed to handle 10 and as water 51 flows into reservoir 50, air 53 is captured and compressed therein. Filling is very simple and easily accomplished. The handle 10 is screwed tightly to the end of spigot 60, the spigot is opened and water is permitted to flow. Flow stops automatically when the pressure of the captured air 53 equalizes the pressure of the water source. The spigot is then closed and the handle unscrewed therefrom. Referring back to FIG. 1, pressurized water applied to hose thread coupling 12 forces ball 34 off of its seat 36 and water flows in channel 22, through siphon tube 26 to air-filled reservoir bottle 50. Trigger ball 30 is forced against its seat 32 by the pressure exerted thereagainst by the water. When pressure is removed from hose thread coupling 12, ball 34 is forced against its seat 36 and pressurized water is trapped in handle 10 and reservoir 50.

In operation, depressing trigger 18 causes plunger 28 to physically force ball 30 away from its seat 32 which results in pressurized water in channel 22 being expelled through nozzle 20. The stream of water will continue as long as ball 30 is off of its seat 32 and there is pressurized water remaining in reservoir 50. Release of trigger 18 is accompanied by trigger ball 30 being immediately forced against its seat 32 by the pressurized water. Thus the water jet is terminated. Return spring 27 provides a positive bias on trigger 18 to assure unobstructed movement of ball 30 against its seat 32. It will be appreciated that trigger 18 is very stable in operation since it rides along the large bushing 19 formed in handle 10 and is stabilized by plunger 28 that rides in bore 25. During normal use of the water gun, a spray type blast may be readily obtained by the user depressing valve ball 34 by inserting a finger into hose coupling 12. A large area spray of water results from this action. In FIG. 4, a weight **26*a* is attached to the end of flexible siphon tube 26**. This assures that the end of the siphon tube will be in water in nearly all positions of the reservoir.

Figure 5:
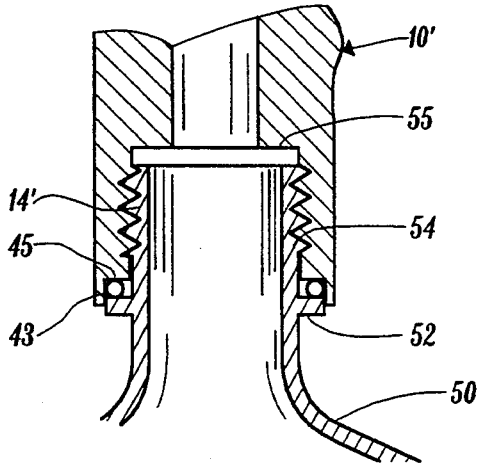
FIG. 5 illustrates a special sealing arrangement on the handle.

FIG. 5 illustrates a modified construction of the end of handle 10 for providing a sealing engagement only with special types of reservoirs, i.e. those that include a collar 52 spaced from the bottle thread 54. In,is arrangement, an O-ring 43 is seated in an internal shoulder 45 at the end of handle 10' and engages the collar 52 of a suitable reservoir 50 before the top end of reservoir 50 engages the surface 55 of handle 10'. This arrangement requires a longer (or deeper) bottle thread portion 14' in the end of handle 10' and precludes a seal from being formed with reservoirs, such as "glass bottles, that do not have a collar 52. The feature precludes use of glass bottles, which may have cracks or defects, as reservoirs and assures the use of the PET type plastic bottles for which the unit is designed. As is well known, the PET type plastic bottle is extremely rugged and capable of easily withstanding the pressures encountered in household water sources.

Figure 6:
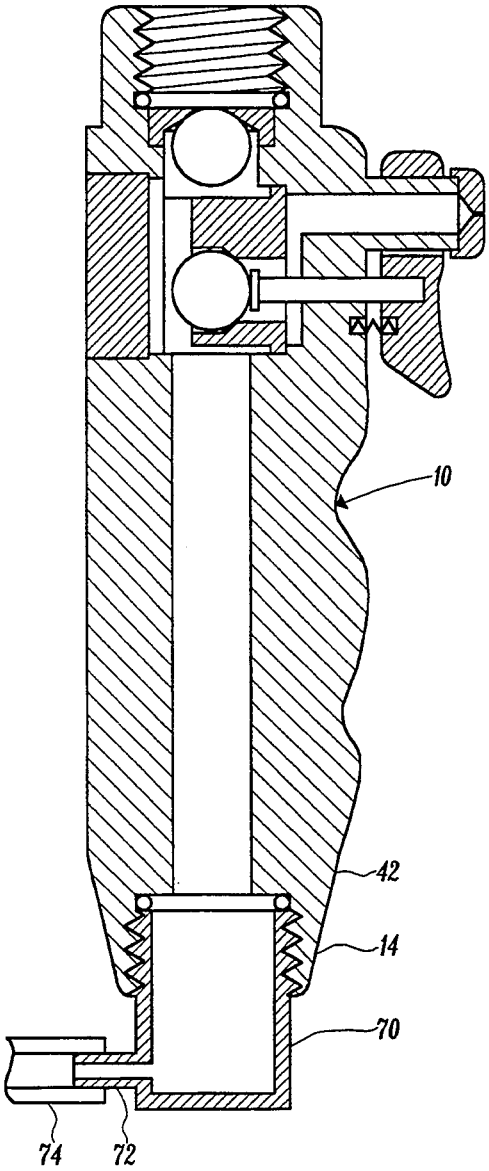
FIG. 6 illustrates an adapter for use with a backpack reservoir system.

In FIG. 6, an adapter 70 is shown for using the handle 10 with a backpack type reservoir system. Adapter 70 includes a bottle thread for sealing engagement with O-ring 42 in bottle thread coupling 14. Adapter 70 also includes a small tubular extension 72 that is engageable by flexible plastic tubing 74.

Figure 7:
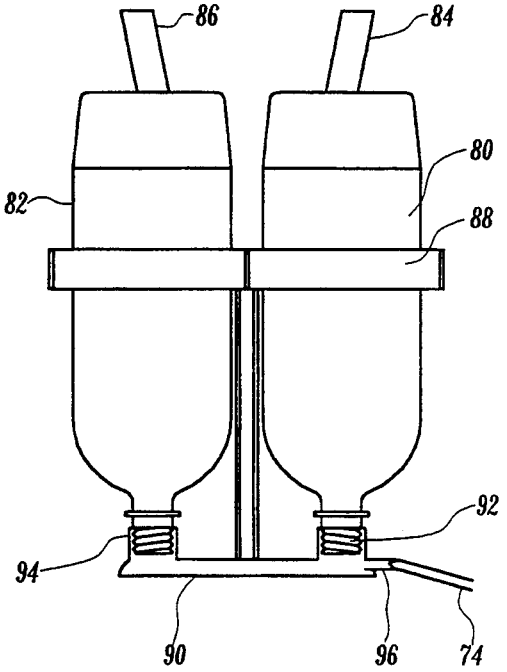
FIG. 7 illustrates a two model reservoir backpack arrangement for use with the handle of FIG. 6.

As shown in FIG. 7, a pair of PET plastic reservoir bottles 80 and 82 may be secured to a user's body by a pair of shoulder straps 84 and 86 attached to a suitable support frame 88. A manifold 90, which includes a pair of internal bottle thread orifices 92 and 94 for receiving, in threaded engagement, reservoirs 80 and 82, also includes a small tubular extension 96 for engagement with flexible tubing 74. Here again, seals are formed between the reservoirs 80 and 82 and the manifold 90. The flexible tubing is sufficiently long and flexible to permit handle 10 to be screwed onto a spigot 60 (FIG. 4) without requiring removal of the backpack from the user's body since only three or four complete turns are involved. It will be appreciated that the PET plastic bottles that are commonly used with carbonated beverages as reservoirs makes the invention extremely attractive and cost effective. They also yield a large storage capability and one that may be pressurized to a significantly higher pressure than can normally be attained with manual pump systems. The trigger and check valve arrangement is simple and trouble-free and readily manufacturable. It has been found that long-distance jet streams are produced until the reservoirs are substantially empty.

Figure 8:
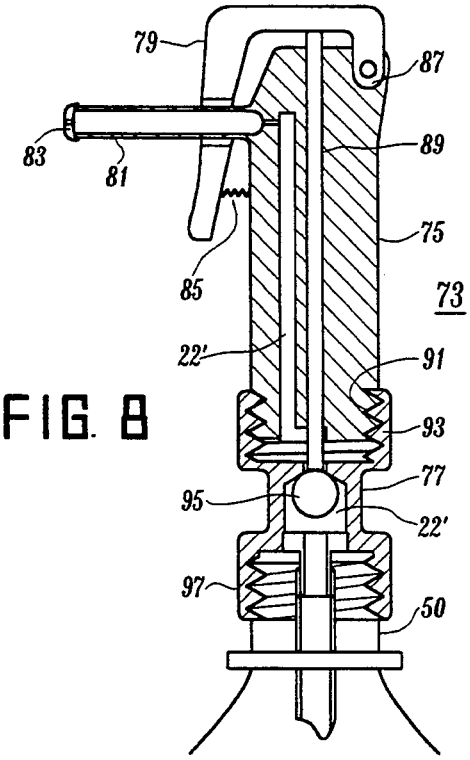
FIG. 8 illustrates a two piece handle version of the invention.

FIG. 8 illustrates a lower cost version of the invention that has an added benefit of readily enabling the stock piling of charged reservoirs. Here the handle 73 is in two detachable portions, an upper portion 75 that includes a trigger 79 and a nozzle extension 81 and a lower portion 77 that includes a hose thread coupling 93, a bottle thread coupling 97 and a combination check ball and trigger ball 95. A cap type nozzle 83 is fitted on nozzle extension 81. Trigger 79 is pivotably mounted to upper portion 75 by a pin 87 and outwardly biased by a spring 85. A trigger plunger 89 acts to move ball 95 off of its seat to permit pressurized water in reservoir 50 to flow into channel 22' and out of nozzle 83. A male hose thread 91 and the end of upper portion 75 of handle 73 is removable from hose thread coupling 93 and usable with other charged reservoir systems, i.e. bottles 50 and lower portions 77.

It is recognized that numerous changes in the described embodiment of the invention will be apparent to those skilled in the art without departing from its true spirit and scope. The invention is to be limited only as defined in the claims.

What is claimed is:

1. A water propulsion toy comprising:

a handle including a channel;

a nozzle in said handle and connected with said channel;

trigger means in said handle for permitting water flow from said channel through said nozzle;

a garden hose thread coupling for connecting said channel to a household source of pressurized water;

a bottle thread coupling means for connecting the threaded end of a plastic beverage bottle reservoir or the like to said channel; and valve means for sealing said channel against escape of pressurized water from said reservoir.

2. The arrangement of claim 1 wherein said valve means comprises a ball and a seat in said channel, said trigger engaging said ball and operable to move said ball off of said seat to permit pressurized water in said plastic beverage bottle reservoir to flow through said nozzle.

3. The arrangement of claim 2 wherein said handle includes an upper portion comprising said trigger and said nozzle and a lower, detachable portion, comprising said hose thread coupling, said bottle thread coupling, said ball and said seat, said ball and said seat also functioning as a check valve for said plastic beverage bottle.

4. The arrangement of claim 3 wherein said upper portion includes a mating hose thread coupling that is removably secured to said hose thread coupling in said lower portion.

5. The arrangement of claim 4, further including a siphon tube, secured in and terminating said channel in said lower portion adjacent said bottle thread coupling, for extending into said plastic beverage bottle.

6. The arrangement of claim 2 wherein said hose thread coupling and said bottle thread coupling are located at opposite ends of said handle.

7. The arrangement of claim 6, wherein said valve means further includes a check valve in said channel adjacent said hose thread coupling.

8. The arrangement of claim 2 wherein a siphon tube is secured in and terminates said channel adjacent said bottle thread coupling and extends into said plastic beverage bottle.

9. The arrangement of claim 1 wherein said plastic beverage bottle includes a collar adjacent the threaded end thereof and wherein said bottle thread coupling comprises an extended thread and a sealing means for sealing said bottle thread coupling against said collar.

10. The arrangement of claim 1 wherein said bottle thread coupling means comprises a backpack carrier means, having a manifold including said bottle thread coupling means, for supporting said reservoir and a flexible hose connecting said manifold to said channel.

11. A toy water gun for controllably squirting a water jet from a pressurized plastic beverage container reservoir having a bottle thread, comprising:

a handle including a trigger and a nozzle;

first coupling means for connecting said handle to said bottle thread of said plastic beverage container reservoir;

second coupling means, including a garden hose thread, for connecting said handle to a source of household pressurized water; and valve means for preventing release of pressurized water in said plastic beverage container reservoir when said handle and said second coupling means are disconnected.

12. The toy water gun of claim 11 wherein said valve means comprises a ball and a seat, said ball being urged against said seat by pressurized water in said plastic beverage container reservoir.

13. The toy water gun of claim 12 wherein a channel is formed in said handle and couples said nozzle and said plastic beverage container reservoir, said trigger being disposed in said channel, and further including a trigger ball, engageable with said trigger, and a trigger seat mounted in said channel for permitting ejection of pressurized water from said plastic beverage container reservoir through said nozzle in response to said trigger displacing said trigger ball from said trigger seat.

14. The toy water gun of claim 13, further including a siphon tube in said handle, said siphon tube terminating said channel and extending into said plastic beverage container reservoir.

15. The toy water gun of claim 14 wherein said plastic beverage container reservoir includes a collar adjacent said bottle thread and wherein said first coupling means comprises an extended thread and seal means for sealing said handle against said collar.

16. The toy water gun of claim 11 wherein said first coupling means comprises a backpack carrier means, having a manifold connectable to said bottle thread, for supporting said reservoir and a flexible hose connecting said manifold to said handle.

* * * * *